US006287407B1

(12) United States Patent
Stein et al.

(10) Patent No.: US 6,287,407 B1
(45) Date of Patent: Sep. 11, 2001

(54) STRUCTURED TEXTILE MATERIAL MADE OF AT LEAST TWO BASE NONWOVEN FABRICS AND METHOD FOR ITS MANUFACTURE

(75) Inventors: Karlheinz Stein, Hemsbach; Heinrich Laun, Augsburg; Michel Pässler, Neusäss, all of (DE)

(73) Assignee: Firma Carl Freudenberg, Weinheim (DE)

( * ) Notice: Subject to any disclaimer, the term of this patent is extended or adjusted under 35 U.S.C. 154(b) by 0 days.

(21) Appl. No.: 09/109,444

(22) Filed: Jul. 2, 1998

(30) Foreign Application Priority Data

Jul. 2, 1997 (DE) ..... 197 28 178

(51) Int. Cl.[7] ..... B32B 31/08

(52) U.S. Cl. ..... 156/148; 156/72; 156/309.6; 156/324

(58) Field of Search ..... 156/148, 324, 156/308.2, 309.6, 72; 28/107, 112

(56) References Cited

U.S. PATENT DOCUMENTS 2,970,365 * 2/1961 Morgenstern ..... 156/148
5,804,007 * 9/1998 Asano ..... 156/72

FOREIGN PATENT DOCUMENTS

0331215 * 9/1989 (EP) .
2 162 213 A 1/1986 (GB) .
60-167958 * 8/1985 (JP) .
WO 90/14039 11/1990 (WO) .
WO 94/23634 10/1994 (WO) .

* cited by examiner

*Primary Examiner*—Sam Chuan Yao
(74) *Attorney, Agent, or Firm*—Kenyon & Kenyon

(57) ABSTRACT

The invention relates to a structured textile material made of at least two different, needled base nonwoven fabrics. The base nonwoven fabrics have a structure obtained by needling from at least one side. The needles used for the structure needling are fork needles or crown needles, and the depth of the forks and barbs, respectively, is so selected that, when piercing through, they completely fill up with fibers of the base nonwoven fabric facing the needles. The textile material have unmixed, pure fibers in the pattern, in the background and on the reverse side.

5 Claims, 2 Drawing Sheets

STRUCTURED TEXTILE MATERIAL MADE OF AT LEAST TWO BASE NONWOVEN FABRICS AND METHOD FOR ITS MANUFACTURE

TECHNICAL FIELD OF THE INVENTION

This invention is directed to the field of structured textile materials that are made of at least two different base nonwoven fabrics, and which find particular application as a cleaning textile.

BACKGROUND OF THE INVENTION

A cleaning textile, made of a structured textile material composed of at least two base nonwoven fabrics, is known from WO 94 23 634. Furthermore, WO 90 14 039 shows a structured, textile, surface-area material that is made of one nonwoven fabric, from which a multitude of thread loops or fiber ends are raised by needling.

A method for its manufacture is disclosed in the British patent 2 162 213. There, the structures are produced by needling a nonwoven fabric, such that fibers or filaments are pulled out from the opposite surface with the assistance of barbs. As a consequence of this method, the structures are made principally from material taken from the respective opposite surface.

The disadvantage of known structured textile materials made of at least two different, unbonded base nonwoven fabrics is that in needling the two unbonded base nonwoven fabrics, a base nonwoven fabric in a mixed color results on the side where the needle comes out. When producing the structures by through-needling the fibers of one base nonwoven fabric through the other base nonwoven fabric, further mixed effects also result which degrade the appearance of the finished textile material and also weaken the specific service properties of the fibrous material of a base nonwoven fabric.

There remains a need for a structured textile material formed from at least two different base nonwoven fabrics, in which such a mixture of the fibers is avoided.

SUMMARY OF THE INVENTION

According to the invention, the base nonwoven fabrics have a structure obtained by needling from at least one side. The needles used for the structure needling are fork needles or crown needles, and the depth of the forks and barbs, respectively, are selected so that when piercing through, they fill up completely with fibers of the base nonwoven fabric facing the needles. Consequently, the textile material produced is characterized by unmixed, pure fibers in the pattern, in the background and on the reverse side.

A textile material having these features has the advantage that the specific service properties of the fibrous material of a base nonwoven fabric are retained during the structuring. In the case where base nonwoven fabrics of different colors are used, the pure original colors are maintained in the pattern, both in the background and on the reverse side. This permits the attainment of various desired visual effects.

To increase the interlaminar strength of the textile, the base nonwoven fabrics, having thermoplastic fibers, can be laminated to one another, and the bonding of the two base nonwoven fabrics can then be further strengthened by activating the vertically positioned thermoplastic fibers. In principle, all known methods and all known binding agents are usable for the laminating, however, it is preferable to utilize those known methods that impart a good bond and a negligible stiffening of the textile material, and furnish a launderability of at least 60° C., and preferably 95° C.

Advantageously, at least one base nonwoven fabric contains thermoplastic fibers whose properties are so selected that they are not activated during the laminating stage. It then becomes possible to provide the unbonded base nonwoven fabrics with the desired structures by needling.

In the same way, the lamination of the two base nonwoven fabrics can be augmented by an intermediate layer made of a material capable of glueing the two base nonwoven fabrics together. This intermediate layer can take the form of an adhesive nonwoven fabric (such as a layer of fibers bonded with adhesives) that can be introduced between the two base nonwoven fabrics having thermoplastic fibers. The two base nonwoven fabrics and the intermediate layer can be bonded by activating the thermoplastic fibers and the intermediate layer. While it is possible that portions of the intermediate layer will be needled into the structure, this is desirable under some circumstances, and can be exploited to increase the interlaminar strength.

Although, in general, the choice of the sides of the nonwoven fabrics to be joined does not matter for the present invention, it is advantageous that the pierce-through sides of the base nonwoven fabrics, reinforced by needling from one side, be facing one another.

To intensify the effect of the structurings, the base nonwoven fabrics can have different material properties, particularly as relating to cleaning ability.

One method according to the invention calls for laminating the two needled base nonwoven fabrics having thermoplastic fibers, without activating the thermoplastic fibers. A structure-needling process is subsequently carried out on one or two sides, and is followed by the activation of the thermoplastic fibers of the base nonwoven fabrics. The result is a structured textile material that is made of at least two different base nonwoven fabrics having structures on one or two both sides formed by needling, in which the textile material retains unmixed, pure fibers in the pattern, in the background and on the reverse side.

Compared to a textile material made of two different nonwoven fabrics needled together, one has the advantage that, until the structuring, the base nonwoven fabrics remain unmixed. The needed strength of the base nonwoven fabrics is obtained by separate needling of the two base nonwoven fabrics before the lamination process.

In another method, prior to feeding the textile laminate into a structure-needling machine, an intermediate layer made of a material capable of glueing the two base nonwoven fabrics, in particular an adhesive nonwoven fabric, is introduced between the two needled base nonwoven fabrics having thermoplastic fibers. The two base nonwoven fabrics and the intermediate layer are subjected together to a structure-needling process on one or two sides. Subsequently, the two base nonwoven fabrics and the intermediate layer are bonded by activating the thermoplastic fibers and the intermediate layer. The result is a structured textile material that is made of at least two varicolored base nonwoven fabrics and has structures on one or two sides formed by needling, the textile material having unmixed, pure fibers in the pattern, in the background and on the reverse side.

This method is especially suited for one-sided structuring. However, it is also usable for structuring on both sides if so much stability is produced by the first pattern, applied on one side, that a second passage is possible without shifting the layers relative to each other.

To attain the best possible purity of the fibers, the process should is advantageously conducted such that the fork needles or crown needles used for the structure needling step completely fill up with fibers of the base nonwoven fabric facing the needles as they pierce them.

BRIEF DESCRIPTION OF THE DRAWINGS

The drawings show a textile material according to the invention, in which.

DETAILED DESCRIPTION OF THE INVENTION

Figure 1:
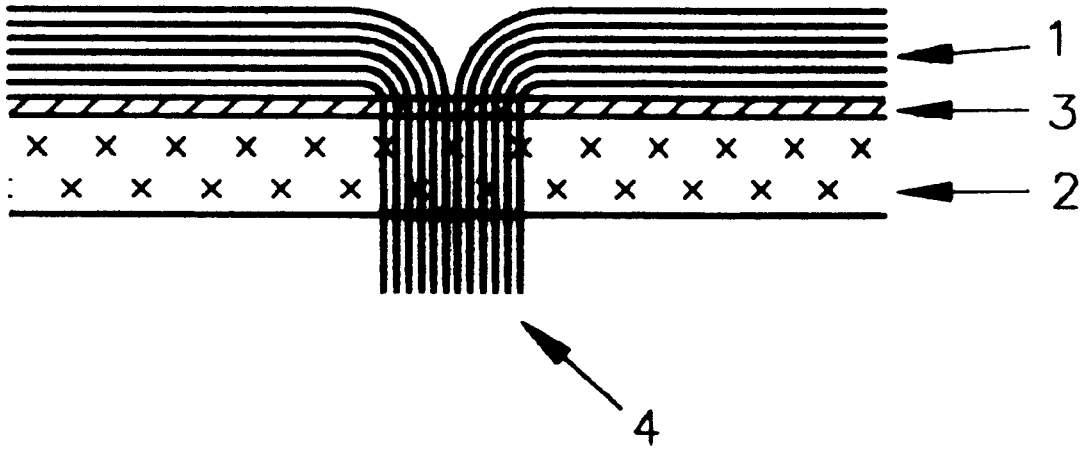
FIG. 1 is a vertical sectional view through the textile material of the invention.

A laminate according to the invention is produced from two different, needled, base nonwoven fabrics 1 and 2, shown in FIG. 1, having the desired weight and the desired material properties. In the illustrated embodiment, the laminate is made up of two layers of pure material (material having a uniform characteristic). The two base nonwoven fabrics 1 and 2 are laminated to one another via an adhesive zone 3, which can be an adhesive nonwoven fabric.

Activation of the thermoplastic fibers contained in base nonwoven fabrics 1 and 2 is avoided during the laminating process, so that structures 4 can subsequently be produced by needling.

The structures are produced on a structuring needle machine such as Dilo, Di-Loop or other, with the assistance of fork needles or crown needles. In so doing, the depth of the forks and barbs, respectively, must be adjusted to the fiber quantity of the nonwoven fabric on the insertion side, so that they fill up completely with the fibers of this nonwoven fabric.

The structured laminate is subsequently thermoset. In so doing, the thermoplastic fibers contained in the base nonwoven fabric are activated. They bond the remaining fibers to one another and increase the strength of the base nonwoven fabrics.

During the process of needling the individual base nonwoven fabrics, and when structure-needling the laminate, the thermoplastic fibers (according to their portion in the fiber mixture) are needled transversely through the material. This has the beneficial consequence that after their activation, the transverse stability or interlaminar strength of the textile material is enhanced.

When using an adhesive nonwoven fabric 3 arranged between base nonwoven fabrics 1 and 2, it is possible to allow the two base nonwoven fabrics 1 and 2 to feed into the structure-needling machine together with adhesive nonwoven fabric 3, and to structure all three layers together by needling.

Provided that there is sufficient resistance of the laminate against displacement of the individual layers due to the needled-in structure 4, it is possible to turn the laminate over and to feed it to the machine once more.

The thermoplastic fibers in the two base nonwoven fabrics and, in the same way, the adhesive nonwoven fabric, are subsequently activated in a procedure for the lamination of the two base nonwoven fabrics 1 and 2. This is easily possible if the thermoplastic fibers and the material of the adhesive nonwoven fabric are adjusted to each other according to the activation conditions needed.

Figure 2:
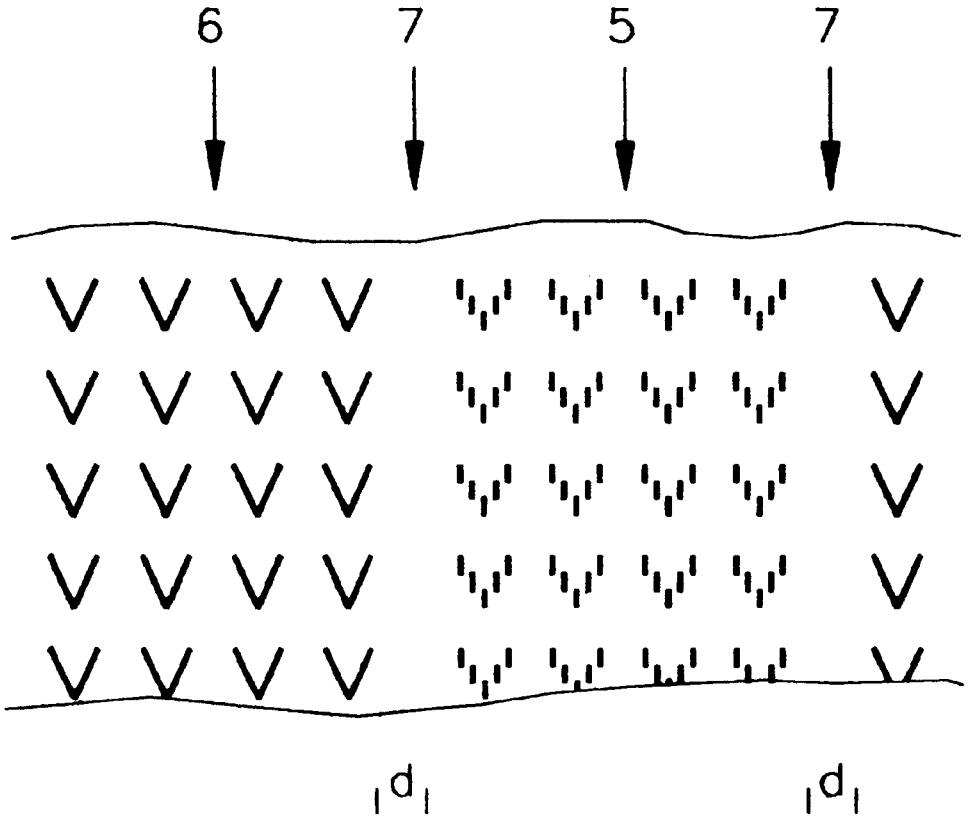
FIG. 2 is a top plan view onto a textile material that has been structured on both sides.

Both procedures, with the assistance of two structuring processes, then allow the introduction of structural features 5 and 6, (as shown in FIG. 2) into both sides of the textile material. These structurings 5 and 6 can take the form of broken stripes running lengthwise which, to avoid over-needling, have a lateral safety spacing d of at least 5 mm.

Structurings 5 are needled from the side facing the observer onto the side facing away from the observer, so that only slits or recesses are visible.

Structurings 6 are needled from the side facing away from the observer onto the side facing the observer, so that here the fiber tufts jutting out above the base nonwoven fabric are visible.

The invention has proven particularly successful in the manufacture of color-pure patterns from two differently colored, base nonwoven fabrics. If a pattern is needled on one side by a structure-needling machine into a laminate composed of two colored, needle-punched nonwovens which can be thermoset, then, in the case of a red and a blue needle-punched nonwoven, for example, dependent upon the selected insertion side of the structure needles, the following product is formed:

| | Insertion side red | Insertion side blue |
|---|---|---|
| Patterning/ Structuring | Red | Blue |
| Background around the patterning | Blue | Red |
| Reverse side | Red | Blue |

All colors are unmixed.

If structuring is carried out on both sides, thus both sides are structure-needled alternately in stripe sectors over the width of the material during two operations, a product is obtained which is structured, alternating, corresponding to these stripe sectors on the top and bottom side.

In this case, the structuring on the one side is red, on the other side blue. The color of the background and of the reverse side in each case is then as shown in the preceding table.

The unstructured spacings 7, having the width d, between the opposing stripe sectors 5 and 6, correspond in color to the base nonwoven fabrics before they are fed into the structure-needling machine.

What is claimed is:

1. A method for producing a structured textile material that is made of at least two different base nonwoven fabrics, each having a characteristic color, comprising the steps of:

providing at least a first base nonwoven fabric and a second base nonwoven fabric that differs from the first nonwoven fabric, both the first and second nonwoven fabrics containing thermoplastic binding fibers capable of binding fibers of the nonwoven fabrics when activated;

inserting an intermediate layer of material capable of adhesive connection to the first and second nonwoven fabrics and laminating the first base nonwoven fabric, the intermediate layer, and the second base nonwoven fabric to form a laminate, without activating the thermoplastic fibers contained therein;

needling at least one side of the laminate to create a structured pattern thereon, the needling being performed by one of a fork needle including a fork and a crown needle including a crown, the one of the fork and the crown being completely filled with fibers of one of the base nonwoven fabric before the fork passes through another one of the base nonwoven fabrics; and activating the intermediate layer and the thermoplastic fibers of the base nonwoven fabrics, wherein the resulting textile exhibits the starting color of one of the fabrics, unmixed with the starting color of the other of the fabrics in the pattern, background and reverse side of the laminate.

2. A method as for producing a structured textile as set forth in claim 1, wherein the intermediate layer is a nonwoven fabric.

3. The method as defined by claim 1, further comprising the step of needling the laminate on both sides.

4. The method as defined by claim 1, wherein the base nonwoven fabrics are selected so that they have different material properties.

5. The method as defined by claim 4, wherein the base nonwoven fabrics differ in their cleaning ability.

* * * * *